US009222054B2

(12) United States Patent
Takeshima et al.

(10) Patent No.: US 9,222,054 B2
(45) Date of Patent: Dec. 29, 2015

(54) CYLINDER LUBRICATING OIL COMPOSITION FOR CROSSHEAD-TYPE DIESEL ENGINE

(75) Inventors: Shigeki Takeshima, Tokyo (JP); Naozumi Arimoto, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 349 days.

(21) Appl. No.: 13/517,169

(22) PCT Filed: Oct. 8, 2010

(86) PCT No.: PCT/JP2010/067770

§ 371 (c)(1),
(2), (4) Date: Jun. 19, 2012

(87) PCT Pub. No.: WO2011/077810

PCT Pub. Date: Jun. 30, 2011

(65) Prior Publication Data

US 2012/0258897 A1 Oct. 11, 2012

(30) Foreign Application Priority Data

Dec. 24, 2009 (JP) ..... 2009-292327

(51) Int. Cl.

*C10M 163/00* (2006.01)
*C10M 111/02* (2006.01)
*C10M 169/04* (2006.01)

(52) U.S. Cl.

CPC ..... *C10M 163/00* (2013.01); *C10M 169/045* (2013.01); *C10M 111/02* (2013.01); *C10M 2203/1006* (2013.01); *C10M 2203/1025* (2013.01); *C10M 2203/1045* (2013.01); *C10M 2203/1085* (2013.01); *C10M 2205/0285* (2013.01); *C10M 2207/026* (2013.01); *C10M 2207/028* (2013.01); *C10M 2207/262* (2013.01); *C10M 2215/064* (2013.01); *C10M 2215/065* (2013.01); *C10M 2215/28* (2013.01); *C10M 2219/046* (2013.01); *C10M 2219/068* (2013.01); *C10M 2223/045* (2013.01); *C10M 2227/09* (2013.01); *C10N 2210/06* (2013.01); *C10N 2220/022* (2013.01); *C10N 2230/02* (2013.01); *C10N 2230/06* (2013.01); *C10N 2230/08* (2013.01); *C10N 2230/10* (2013.01); *C10N 2230/52* (2013.01); *C10N 2240/102* (2013.01)

(58) Field of Classification Search

CPC ..... C10M 163/00; C10M 111/02; C10M 169/045; C10M 2203/1006; C10M 2203/1025; C10M 2203/1045; C10M 2203/1085; C10M 2205/0285; C10M 2207/026; C10M 2207/028; C10M 2207/262; C10M 2215/064; C10M 2215/065; C10M 2215/28; C10M 2219/046; C10M 2219/068; C10M 2223/045; C10M 2227/09; C10N 2210/06; C10N 2220/022; C10N 2230/02; C10N 2230/06; C10N 2230/08; C10N 2230/10; C10N 2230/52; C10N 2240/102

USPC ..... 508/365, 563

See application file for complete search history.

(56) References Cited

U.S. PATENT DOCUMENTS

| | | | | |
|---|---|---|---|---|
| 5,605,880 | A | 2/1997 | Arai et al. | |
| 6,174,842 | B1 | 1/2001 | Gatto et al. | |
| 6,339,051 | B1 * | 1/2002 | Carey et al. | 508/391 |
| 2003/0073590 | A1 | 4/2003 | Chambard et al. | |
| 2005/0153847 | A1 * | 7/2005 | Chambard et al. | 508/185 |
| 2006/0116298 | A1 * | 6/2006 | Chambard et al. | 508/287 |
| 2008/0153723 | A1 * | 6/2008 | Boons et al. | 508/150 |
| 2011/0092403 | A1 * | 4/2011 | Lancon et al. | 508/391 |

FOREIGN PATENT DOCUMENTS

| | | | |
|---|---|---|---|
| EP | 0 696 636 | A1 | 2/1996 |
| EP | 0719313 | B1 | 7/1996 |
| EP | 1041134 | A2 | 10/2000 |
| JP | 06-313183 | A | 11/1994 |
| JP | 09-506118 | A | 8/1997 |
| JP | 2000-290675 | A | 10/2000 |
| JP | 2003-119484 | A | 4/2003 |
| JP | 3507915 | B | 1/2004 |
| JP | 3608805 | B | 10/2004 |
| JP | 2005-281613 | A | 10/2005 |
| JP | 2005-281614 | A | 10/2005 |
| JP | 2007-197700 | A | 8/2007 |

(Continued)

OTHER PUBLICATIONS

Supplementary European Search Report issued Jun. 13, 2013 in EP Application No. 10 83 9047.

(Continued)

*Primary Examiner* — James Goloboy
(74) *Attorney, Agent, or Firm* — Panitch Schwarze Belisario & Nadel LLP

(57) ABSTRACT

The present invention provides a cylinder lubricating oil composition for a crosshead-type diesel engine, which is improved in oxidation stability and anti-scuffing properties besides the properties of the conventional cylinder lubricating oil composition and comprises a base oil having an aromatic content of 8.5 percent by mass or more and on the basis of the total mass of the composition (A) an alkaline earth metal phenate in an amount of 0.005 mole/kg or more on the basis of phenate soap content, (B) an aminic antioxidant in an amount of 0.1 to 5 percent by mass and (C) an oil-soluble molybdenum compound in an amount of 30 to 500 ppm by mass on the basis of molybdenum and having a base number of 20 to 100 mgKOH/g and a 100° C. kinematic viscosity of 12.6 $mm^2/s$ or higher.

8 Claims, No Drawings

(56) References Cited

FOREIGN PATENT DOCUMENTS

| | | | |
|---|---|---|---|
| JP | 2008-239774 | A | 10/2008 |
| WO | 9964543 | A1 | 12/1999 |
| WO | 2005095559 | A1 | 10/2005 |
| WO | 2009082033 | A1 | 7/2009 |
| WO | WO 2009153453 | A2 * | 12/2009 |

OTHER PUBLICATIONS

Int'l Search Report issued Nov. 16, 2010 in Int'l Application No. PCT/JP2010/067770.

* cited by examiner

CYLINDER LUBRICATING OIL COMPOSITION FOR CROSSHEAD-TYPE DIESEL ENGINE

CROSS-REFERENCE TO RELATED APPLICATION

This application is a Section 371 of International Application No. PCT/JP2010/067770, filed Oct. 8, 2010, which was published in the Japanese language on Jun. 30, 2011, under International Publication No. WO 2011/077810 A1, and the disclosure of which is incorporated herein by reference.

TECHNICAL FIELD

The present invention relates to a cylinder lubricating oil composition for a crosshead-type diesel engine.

BACKGROUND ART

For a crosshead-type diesel engine, a cylinder oil for lubricating the friction point between the cylinders and pistons and a system oil for lubricating and cooling other portions have been used. The cylinder oil is required to have a suitable viscosity needed to lubricate a friction portion between a cylinder and a piston (piston ring) and a function to maintain detergency needed to allow a piston and a piston ring to move appropriately. Furthermore, since for this engine, a high-sulfur content fuel is generally used for the economy reason, it has a problem that acidic components such as sulfuric acid generated by the combustion of the fuel corrode a cylinder. In order to avoid this problem, the cylinder oil is required to have a function to neutralize the acidic components such as sulfuric acid so as to prevent corrosion.

Meanwhile, for the purpose of further improving properties, a recent crosshead-type diesel engine tends to be directed toward increases in the cylinder diameter (for example, 70 cm or greater bore size), in the piston stroke (for example, ultra long stroke such that it is 8 m/s or more at an average speed) and in the combustion pressure (for example, 1.8 MPa or greater brake mean effective pressure (BMEP)), resulting in an increase in the temperatures of the piston and cylinder wall. The increase in the combustion pressure involves the dew point rise of sulfuric acid causing a cylinder to be likely to corrode by sulfuric acid. Furthermore, for the measure of inhibiting the corrosion by sulfuric acid, the cylinder wall temperature tends to be increased (for example, 250° C. or higher cylinder wall temperature) and also the amount of a lubricating oil to be lubricated into a cylinder has been decreased. The circumstances concerning the lubrication of a cylinder has become remarkably severer. As such change of the circumstances, the anti-scuffing properties of a lubricating oil has been required to be urgently improved (Patent Literature 1, Patent Literature 2).

The cylinder oil is a lubricating oil that is of a once-through type and thus has never been considered in respect of oxidation stability (Patent Literature 1, Patent Literature 2). The inventors of the present application have found that addition of specific antioxidant can improve significantly not only the antioxidation properties but also the anti-scuffing properties of a cylinder oil. Meanwhile, the oxidation stability of a lubricating oil is known to be improved by using a base oil with a less aromatic component or adding an antioxidant. Molybdenum compounds are also known to be act as antioxidant (Patent Literature 3, Patent Literature 4). Patent Literature 3 discloses that a crank case oil comprising a hydrocracked base oil, an oil-soluble molybdenum compound from which sulfur is removed, an oil-soluble diarylamine and a phenate of an alkaline earth metal is excellent in oxidation stability and decreases the wear of a tappet and the deposits on rings and valves. Patent Literature 4 discloses that a lubricating oil comprising a base oil with an aromatic content of 3.0 percent by mass or less, alkyldiphenylamines and/or phenyl-α-naphthylamines and sulfurized oxymolybdenum dithiocarbamate and/or sulfurized oxymolybdenum organophosphorodiate has high heat-resistnce and oxidation stability and low friction properties.

CITATION LIST

Patent Literature

Patent Literature 1: Japanese Patent Laid-Open Publication No. 2008-239774
Patent Literature 2: Japanese Patent Laid-Open Publication No. 2007-197700
Patent Literature 3: Japanese Patent No. 3507915
Patent Literature 4: Japanese Patent No. 3608805

SUMMARY OF INVENTION

Technical Problem

The present invention has an object to provide a cylinder lubricating oil composition for a crosshead-type diesel engine, which has improved oxidation stability and anti-scuffing properties, maintaining the properties of the conventional lubricating oil compositions.

Solution to Problem

As the results of extensive study and research, the present invention was accomplished on the basis of the finding that a lubricating oil composition comprising a base oil having an aromatic content of 8.5 percent by mass or more to which an alkaline earth metal phenate, an aminic antioxidant and an oil-soluble molybdenum compound are each added at a specific ratio is effective as a cylinder lubricating oil composition for a crosshead-type diesel engine.

That is, the present invention relates to a cylinder lubricating oil composition for a crosshead-type diesel engine, comprising a base oil having an aromatic content of 8.5 percent by mass or more and on the basis of the total mass of the composition (A) an alkaline earth metal phenate in an amount of 0.005 mole/kg or more on the basis of phenate soap content, (B) an aminic antioxidant in an amount of 0.1 to 5 percent by mass and (C) an oil-soluble molybdenum compound in an amount of 30 to 500 ppm by mass on the basis of molybdenum and having abase number of 20 to 100 mgKOH/g and a 100° C. kinematic viscosity of 12.6 $mm^2/s$ or higher.

The present invention also relates to the foregoing cylinder lubricating oil composition for a crosshead-type diesel engine wherein (B) the aminic antioxidant is an alkyldiphenylamine and/or N-phenyl-α-naphthylamine.

The present invention also relates to the foregoing cylinder lubricating oil composition for a crosshead-type diesel engine wherein (C) the oil-soluble molybdenum compound is molybdenum dithiocarbamate and/or molybdenum dithiophosphate.

The present invention also relates to the foregoing cylinder lubricating oil composition for a crosshead-type diesel engine further comprising (D) an ashless dispersant in an amount of 1 to 8 percent by mass on the basis of the total mass of the composition.

Advantageous Effects of Invention

The lubricating oil composition of the present invention is excellent in anti-scuffing properties, heat resistance and oxidation stability and suitable as a cylinder lubricating oil composition for a crosshead-type diesel engine and in particular exhibits excellent effects as a cylinder lubricating oil composition for an electronically-controlled two stroke cycle diesel engine driven under any or all of such conditions that an ultra long stroke is so that an average piston speed is 8 m/s or greater, preferably 8.5 m/s or greater, a combustion pressure is so that brake mean effective pressure (BMEP) is 1.8 MPa or greater, preferably 1.9 MPa or greater, and a cylinder wall temperature is so that the highest temperature thereof is 230° C. or higher, preferably 250° C. or higher, particularly preferably 270° C. or higher.

DESCRIPTION OF EMBODIMENTS

The present invention will be described in details below.

No particular limitation is imposed on the type of lubricating base oil to be used in the cylinder lubricating oil composition for a crosshead-type diesel engine of the present invention (hereinafter merely referred to as "the lubricating oil composition of the present invention"), which may be a mineral oil, a synthetic oil, or a mixture thereof.

Specific examples of the mineral base oil include those which can be produced by subjecting a lubricating oil fraction produced by vacuum-distilling an atmospheric distillation bottom oil resulting from atmospheric distillation of a crude oil, to any one or more treatments selected from solvent deasphalting, solvent extraction, hydrocracking, solvent dewaxing, and hydrorefining; wax-isomerized mineral oils; and those produced by isomerizing GTL WAX (Gas to Liquid Wax) produced through Fischer-Tropsch process.

Specific examples of the synthetic base oil include polybutenes and hydrogenated compounds thereof; poly-α-olefins such as 1-octene oligomer and 1-decene oligomer, and hydrogenated compounds thereof; copolymers of ethylene and α-olefins having 2 to 30 carbon atoms; diesters such as ditridecyl glutarate, di-2-ethylhexyl adipate, diisodecyl adipate, ditridecyl adipate and di-2-ethylhexyl sebacate; polyol esters such as trimethylolpropane caprylate, trimethylolpropane pelargonate, pentaerythritol 2-ethylhexanoate and pentaerythritol pelargonate; copolymers of dicarboxylic acids such as dibutyl maleate and α-olefins having 2 to 30 carbon atoms; aromatic synthetic oils such as alkylnaphthalenes, alkylbenzenes, and aromatic esters; and mixtures of the foregoing.

The lubricating base oil used in the lubricating oil composition of the present invention may be any one or more type of the mineral base oils or synthetic base oils or a mixture of one or more of the mineral base oils and one or more of the synthetic base oils.

The lower limit of the aromatic content of the lubricating base oil of the lubricating oil composition of the present invention is necessarily 8.5 percent by mass or more, preferably 12.5 percent by mass or more, more preferably 15 percent by mass or more on the basis of the total mass of the lubricating base oil. The upper limit of the aromatic content is preferably 49 percent by mass or less, more preferably 45 percent by mass or less, more preferably 40 percent by mass or less on the basis of the total mass of the lubricating base oil. If the aromatic content of the lubricating base oil is less than 8.5 percent by mass, the base oil could be decreased in solubility of additives and deposit precursors. If the aromatic content is more than 49 percent by mass, the amount of deposits could be increased, or conglutination on rings could occur, due to the degradation of the lubricating oil.

The aromatic content referred herein denotes the value measured in accordance with ASTM D 2007-93. The aromatics includes alkylbenzenes; alkylnaphthalens; anthracene, phenanthrene, and alkylated products thereof; compounds wherein four or more benzene rings are condensated to each other; and compounds having hetero atoms such as pyridines, quinolines, phenols, and naphthols.

No particular limitation is imposed on the 100° C. kinematic viscosity of the lubricating base oil used in the present invention, which is, however, preferably 40 $mm^2/s$ or lower, more preferably 35 $mm^2/s$ or lower, more preferably 30 $mm^2/s$ or lower, particularly preferably 20 $mm^2/s$ or lower. Meanwhile, the 100° C. kinematic viscosity is preferably 4 $mm^2/s$ or higher, more preferably 6 $mm^2/s$ or higher, more preferably 8 $mm^2/s$ or higher. The 100° C. kinematic viscosity referred herein denotes one defined by ASTM D-445. If the 100° C. kinematic viscosity of the lubricating base oil is higher than 40 $mm^2/s$; the resulting composition could be deteriorated in low temperature viscosity characteristics. If the 100° C. kinematic viscosity is lower than 4 $mm^2/s$, the resulting lubricating oil composition would be poor in lubricity due to its insufficient oil film formation at lubricating sites and would be large in evaporation loss of the composition.

No particular limitation is imposed on the 40° C. kinematic viscosity of the lubricating base oil used in the present invention, which is, however, preferably 700 $mm^2/s$ or lower, more preferably 570 $mm^2/s$ or lower, more preferably 450 $mm^2/s$ or lower, particularly preferably 240 $mm^2/s$ or lower. Whereas, the 40° C. kinematic viscosity is preferably 20 $mm^2/s$ or higher, 0.30 $mm^2/s$ or higher, more preferably 80 $mm^2/s$ or higher. If the 40° C. kinematic viscosity of the lubricating base oil is higher than 700 $mm^2/s$, the resulting composition could be deteriorated in low temperature viscosity characteristics. If the 40° C. kinematic viscosity of the lubricating base oil is lower than 20 $mm^2/s$, the resulting lubricating oil composition would be poor in lubricity due to its insufficient oil film formation at lubricating sites and could be large in evaporation loss of the composition.

The viscosity index of the lubricating base oil used in the present invention is preferably 85 or greater, more preferably 90 or greater, more preferably 95 or greater. No particular limitation is imposed on the upper limit of the viscosity index. Normal paraffin, slack wax or GTL wax or isoparaffinic mineral oils produced by isomerizing the foregoing may also be used.

The viscosity index referred herein denotes one measured in accordance with JIS K 2283-1993.

The % $C_A$ of the lubricating base oil used in the present invention is preferably 1.9 or greater, more preferably 2.7 or greater, more preferably 3.7 or greater. If the % $C_A$ of the lubricating base oil is less than 1.9, the resulting lubricating oil composition could not obtain sufficient antioxidation properties. The % $C_A$ used herein denote the percentages of the aromatic carbon number in the total carbon number, determined by a method (n-d-M ring analysis) in accordance with ASTM D 3238-85.

The lubricating oil composition of the present invention contains necessarily an alkaline earth metal phenate (hereinafter referred to as phenate metal detergent (A)) as Component (A). For example, the phenate metal detergent (A) is a phenate metal detergent containing an alkaline earth metal salt of an alkylphenol, an alkylphenolsulfide or a Mannich reaction product of an alkylphenol represented by formulas (1) to (3) below or an (overbased) basic salt of the alkaline earth metal salt.

Examples of the alkaline earth metal include magnesium, barium, and calcium. Preferred are magnesium and calcium, and particularly preferred is calcium.

(1)

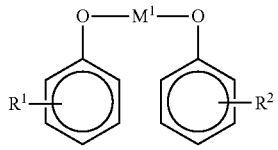

(2)

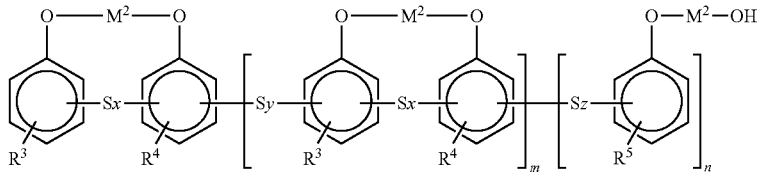

(3)

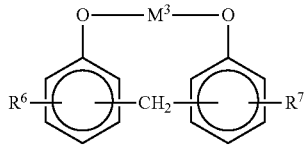

In formulas (1) to (3), $R^1$, $R^2$, $R^3$, $R^4$, $R^5$, $R^6$ and $R^7$ may be the same or different from each other and each independently a straight-chain or branched alkyl group having 4 to 30 carbon atoms, preferably 6 to 18 carbon atoms. If the carbon number is fewer than 4, Component (A) would be poor in dissolubility in the lubricating base oil. If the carbon number is more than 30, Component (A) would be difficult to produce and poor in heat resistance. Specific examples of the alkyl group for $R^1$, $R^2$, $R^3$, $R^4$, $R^5$, $R^6$, and $R^7$ are butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups. These alkyl groups may be straight-chain or branched and may be of primary, secondary, or tertiary.

$M^1$, $M^2$ and $M^3$ are each independently an alkaline earth metal, preferably calcium and/or magnesium, x, y and z are each independently an integer of 1 to 3, m is 0, 1 or 2, and n is 0 or 1.

The base number of the phenate metal detergent (A) is in the range of preferably 50 to 400 mgKOH/g, more preferably 100 to 350 mgKOH/g, more preferably 120 to 300 mgKOH/g. If the base number is less than 50 mgKOH/g, corrosive wear could be increased. If the base number is greater than 400 mgKOH/g, a problem regarding dissolubility would arise.

The term "base number" used herein denotes one measured by the perchloric acid potentiometric titration method in accordance with section 7 of JIS K2501 "Petroleum products and lubricants-Determination of neutralization number".

No particular limitation is imposed on the metal ratio of the phenate metal detergent (A). The lower limit is, however, 1 or greater, preferably 2 or greater, particularly preferably 2.5 or greater while the upper limit is 20 or less, preferably 15 or less, more preferably 10 or less. The term "metal ratio" used herein is represented by "valence of metal element×metal element content (mole %)/soap group content (mole %)" in the phenate metal detergent (A)". The metal element denotes an alkaline earth metal such as calcium and magnesium. The soap group denotes phenol group.

The content of Component (A) described above in the lubricating oil composition of the present invention is necessarily 0.005 mole/kg or more, preferably 0.01 mole/kg or more, more preferably 0.015 mole/kg or more as the soap group on the basis of the total mass of the composition. If the content is less than 0.005 mole/kg, the resulting composition could not obtain necessary heat resistance and anti-scuffing properties.

The lubricating oil composition of the present invention may contain a metal detergent other than the phenate metal detergent (A) in order to adjust the base number of the composition. Specifically, the metal detergent may be one or more metal detergents selected from sulfonate detergents, salicylate detergents, carboxylate detergents, and phosphonate detergents.

The sulfonate detergent may be an alkali metal salt or alkaline earth metal salt of an alkyl aromatic sulfonic acid produced by sulfonating an alkyl aromatic compound having a molecular weight of 300 or more, preferably 400 to 700 and/or an (overbased) basic salt of the alkali metal salt or alkaline earth metal salt. Examples of the alkali metal or alkaline earth metal include sodium, potassium, magnesium, barium and calcium. Preferred are magnesium and/or calcium. Particularly preferred is calcium.

Specific examples of the alkyl aromatic sulfonic acid include, petroleum sulfonic acids and synthetic sulfonic acids. The petroleum sulfonic acids may be those produced by sulfonating an alkyl aromatic compound contained in the lubricant fraction of a mineral oil or may be mahogany acid by-produced upon production of white oil. The synthetic sulfonic acids may be those produced by sulfonating an alkyl benzene having a straight-chain or branched alkyl group, produced as a by-product from a plant for producing an alkyl benzene used as the raw material of a detergent or produced by alkylating polyolefin to benzene, or those produced by sulfonating alkylnaphthalenes such as dinonylnaphthalene. No particular limitation is imposed on the sulfonating agent used for sulfonating these alkyl aromatic compounds. In general, fuming sulfuric acids or sulfuric acid may be used.

The salicylate detergent may be an alkali metal or alkaline earth metal salicylate having one hydrocarbon group having 1 to 19 carbon atoms and/or an (overbased) basic salt thereof; an alkali metal or alkaline earth metal salicylate having one hydrocarbon group having 20 to 40 carbon atoms and/or an (overbased) basic salt thereof; or an alkali metal or alkaline earth metal salicylate having two or more hydrocarbon groups having 1 to 40 carbon atoms and/or an (overbased) basic salt thereof (these alkyl groups may be the same or different). Examples of the alkali metal or alkaline earth metal include sodium, potassium, magnesium, barium, and calcium. Preferred are magnesium and/or calcium. Particularly preferred is calcium.

The base number of the metal detergent other than the phenate metal detergent (A) used in the present invention is in the range of preferably 100 to 500 mgKOH/g, more preferably 120 to 450 mgKOH/g, more preferably 150 to 400 mgKOH/g. If the base number is less than 100 mgKOH/g, corrosive wear could be increased. If the base number is greater than 500 mgKOH/g, a problem regarding dissolubility would arise. No particular limitation is imposed on the metal ratio of the metallic detergent. The lower limit is, however, 1 or greater, preferably 2 or greater, particularly preferably 2.5 or greater. The upper limit is 20 or less, more preferably 15 or less, particularly preferably 10 or less.

The content of the metal detergent other than the phenate metal detergent (A) in the lubricating oil composition is from 0 to 30 percent by mass, preferably from 0 to 20 percent by mass, particularly preferably from 0 to 15 percent by mass in the form of containing a diluent such as a lubricating base oil on the basis of the total mass of the composition.

The lubricating oil composition of the present invention contains necessarily an aminic antioxidant as Component (B). Examples of the aminic antioxidant used in the present invention include diphenylamines having one or more alkyl group having 4 to 20 carbon atoms (hereinafter merely referred to as "diphenylamines") and N-phenyl-α-naphtylamine. Preferred is diphenylamines.

The substituent of the diphenylamine may be positioned at any position on the benzene ring. When the diphenylamine has two or more alkyl groups, these alkyl groups may be positioned on any of the benzene rings. The carbon number of the alkyl group is preferably from 4 to 20, more preferably from 4 to 15, more preferably from 4 to 12. If the carbon number is fewer than 4, the resulting composition could be insufficient in antioxidation properties. If the carbon number is more than 20, it could make it difficult to produce the composition.

Specific examples of the diphenylamines include straight-chain or branched dibutyldiphenylamine, straight-chain or branched dioctyldiphenylamine, straight-chain or branched dinonylphenylamine, straight-chain or branched didecyldiphenylamine, and mixtures thereof. Preferred are dibutyldiphenylamine and dioctyldiphenylamine.

No particular limitation is imposed on the content of Component (B) in the lubricating oil composition of the present invention. However, the content is preferably 0.1 percent by mass or more, more preferably 0.15 percent by mass or more, more preferably 0.2 percent by mass or more, particularly preferably 0.3 percent by mass or more and preferably 5 percent by mass or less, more preferably 3 percent by mass or less, particularly preferably 2 percent by mass or less. If the content is less than 0.1 percent by mass, the resulting lubricating composition tends to be insufficient in thermal and oxidation stability. If the content of Component (B) is more than 5 percent by mass, the resulting composition tends to be poor in storage stability.

The lubricating oil composition of the present invention contains necessarily an oil-soluble molybdenum compound as Component (C). Examples of the oil-soluble molybdenum compound include sulfur-containing organic molybdenum compounds such as molybdenum dithiophosphate (MoDTP) and molybdenum dithiocarbamate (MoDTC); complexes of molybdenum compounds (for example, molybdenum oxides such as molybdenum dioxide and molybdenum trioxide, molybdic acids such as orthomolybdic acid, paramolybdic acid, and sulfurized (poly)molybdic acid, metal salts of these molybdic acids, molybdic acid salts such as ammonium salts of these molybdic acids, molybdenum sulfides such as molybdenum disulfide, molybdenum trisulfide, molybdenum pentasulfide, and molybdenum polysulfide, sulfurized molybdenum acid, metal and amine salts of sulfurized molybdenum acid, and halogenated molybdenum such as molybdenum chloride) and sulfur-containing organic compounds (for example, alkyl(thio)xanthate, thiaziazole, mercaptothiadiazole, thiocarbonate, tetrahydrocarbylthiuramdisulfide, bis(di(thio)hydrocarbyldithiophosphonate)disulfide, organic (poly) sulfide, and sulfurized esters) or other organic compounds; complexes of sulfur-containing molybdenum compounds such as the above-mentioned molybdenum sulfides and sulfurized molybdenum acid and alkenyl succinicimide.

Alternatively, the oil-soluble molybdenum compound may be an oil-soluble molybdenum compound containing no sulfur as a constituent element. Examples of such a molybdenum compound include molybdenum-amine complexes, molybdenum-succinicimide complexes, molybdenum salts of organic acids, and molybdenum salts of alcohols, among which preferred are molybdenum-amine complexes, molybdenum salts of organic acids, and molybdenum salts of alcohols.

Among these oil-soluble molybdenum compounds, preferred are MoDTC and/or MoDTP, most preferred is MoDTC.

The content of Component (C) if contained in the lubricating oil composition of the present invention is preferably from 30 to 500 ppm by mass on the basis of molybdenum of the total mass of the composition. The lower limit content on the basis of molybdenum is preferably 50 ppm by mass or more, more preferably 80 ppm by mass or more while the upper limit content is preferably 400 ppm by mass or less, more preferably 300 ppm by mass or less. If the content on the basis of molybdenum is less than 30 ppm by mass, sufficient anti-scuffing properties may not be attained. If the content is more than 500 ppm by mass, the detergency of the resulting composition would be adversely affected.

In addition to the above-described components in order to further improve the properties of the lubricating oil composition of the present invention or add other required properties thereto, any additives that have been conventionally used in a lubricating oil may be added in accordance with the purposes. Examples of such additives include ashless dispersants, antioxidants, friction modifiers, viscosity index improvers, corrosion inhibitors, rust inhibitors, demulsifiers, metal deactivators, pour point depressants, anti-foaming agents, and dyes.

The lubricating oil composition of the present invention may contain an ashless dispersant as Component (D).

The ashless dispersant may be any ashless dispersant that has been used in a lubricating oil. Examples of the ashless dispersant include nitrogen-containing compounds having in their molecules at least one straight-chain or branched alkyl or alkenyl group having 40 to 400, preferably 60 to 350 carbon atoms and derivatives thereof, Mannich dispersants, and modified products of alkenyl succinicimides. When Component (D) is used, any one or more of these compounds may be added.

If the carbon number of the alkyl or alkenyl group of the nitrogen-containing compounds or derivatives thereof is fewer than 40, Component (D) would be poor in dissolubility in the lubricating base oil. Whereas, if the carbon number of the alkyl or alkenyl group is more than 400, the resulting lubricating oil composition would be deteriorated in low-temperature fluidity. The alkyl or alkenyl group may be straight—chain or branched but is preferably a branched alkyl or alkenyl group derived from oligomers of olefins such as propylene, 1-butene or isobutylene or a cooligomer of ethylene and propylene.

The ashless dispersant may be any one or more of compound selected from the following Components (D-1) to (D-3):

(D-1) succinimides having in their molecules at least one alkyl or alkenyl group having 40 to 400 carbon atoms and derivatives thereof;

(D-2) benzylamines having in their molecules at least one alkyl or alkenyl group having 40 to 400 carbon atoms and derivatives thereof; and (D-3) polyamines having in their molecules at least one alkyl or alkenyl group having 40 to 400 carbon atoms and derivatives thereof.

Specific examples of (D-1) succinimides include compounds represented by formulas (4) and (5):

(4)

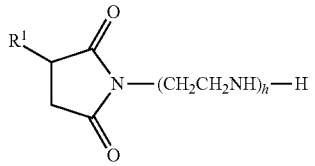

(5)

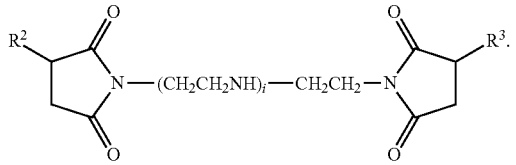

In formula (4), $R^1$ is an alkyl or alkenyl group having 40 to 400, preferably 60 to 350, and h is an integer of 1 to 5, preferably 2 to 4. In formula (5), $R^2$ and $R^3$ are each independently an alkyl or alkenyl group having 40 to 400, preferably 60 to 350 carbon atoms, and particularly preferably polybutenyl group, and i is an integer of 0 to 4, preferably 1 to 3.

Components (D-1) include mono-type succinimides wherein a succinic anhydride is added to one end of a polyamine, as represented by formula (4) and bis-type succinimides wherein a succinic anhydride is added to both ends of a polyamine, as represented by formula (5). The lubricating oil composition of the present invention may contain either type of the succinimides or mixtures thereof but preferably contains bis-type succinimides.

Specific examples of the polyamine include diethylene triamine, triethylene tetramine, tetraethylene pentamine, and pentaethylene hexamine.

Specific examples of Components (D-2) include compounds represented by formula (6):

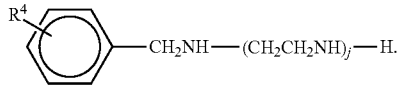

In formula (6), $R^4$ is an alkyl or alkenyl group having 40 to 400, preferably 60 to 350 carbon atoms, and j is an integer of 1 to 5, preferably 2 to 4.

No particular limitation is imposed on the method for producing the benzylamines that are Components (D-2). They may be produced by reacting a polyolefin such as a propylene oligomer, polybutene, or ethylene-α-olefin copolymer with a phenol so as to produce an alkylphenol and then subjecting the alkylphenol to Mannich reaction with formaldehyde and a polyamine such as diethylenetriamne, triethylenetetramine, tetraethylenepentamine, or pentaethylenehexamine.

Specific examples of Component (D-3) include compounds represented by formula (7):

$$R^5—NH—(CH_2CH_2NH)_k—H \quad (7)$$

wherein $R^5$ is an alkyl or alkenyl group having 40 to 400, preferably 60 to 350, and k is an integer of 1 to 5, preferably 2 to 4.

No particular limitation is imposed on the method for producing the polyamines that are Components (D-3). For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, and pentaethylenehexamine.

Specific examples of the nitrogen-containing compound derivative that is an example of the ashless dispersant include a boron-modified compound produced by allowing any of the above-described nitrogen-containing compounds to react with boric acid so as to neutralize or amidize the whole or part of the remaining amino and/or imino groups; a modified compound produced by allowing any of the above-described nitrogen-containing compounds to react with a monocarboxylic acid (fatty acid) having 1 to 30 carbon atoms, or a polycarboxylic acid having 2 to 30 carbon atoms, such as oxalic acid, phthalic acid, trimellitic acid, and pyromellitic acid or anhydrate and esterified compounds thereof, an alkylene oxide having 2 to 6 carbon atoms or hydroxy(poly) oxyalkylenecarbonate, i.e., by an oxygen-containing organic compound so as to neutralize or amidize the whole or part of the remaining amino and/or imino groups; a phosphoric acid-modified compound produced by allowing any of the above-described nitrogen-containing compounds to react with phosphoric acid so as to neutralize or amidize the whole or part of the remaining amino and/or imino groups; a sulfur-modified compound produced by allowing any of the above-described nitrogen-containing compounds to react with a sulfuric compound; and a modified product produced by combining two or more selected from the modifications with boron an oxygen-containing organic compound, phosphoric acid, and sulfur, of the above-described nitrogen-containing compounds.

The content of the ashless dispersant if contained in the lubricating oil composition of the present invention is preferably from 1 to 8 percent by mass on the basis of the total mass of the composition.

The lubricating oil composition of the present invention may contain an extreme pressure additive. Eligible extreme pressure additives are any extreme pressure additives and anti-wear agents that have been used in a lubricating oil. For example, sulfuric-, phosphoric- and sulfuric-phosphoric extreme pressure additives may be used. Specific examples include phosphorus acid esters, thiophosphorus acid esters, dithiophosphorus acid esters, trithiophosphorus acid esters, phosphoric acid esters, thiophosphoric acid esters, dithiophosphoric acid esters, trithiophosphoric acid esters, amine salts, metal salts or derivatives thereof, dithiocarbamates, zinc dithiocaramates, molybdenum dithiocarbamates, disulfides, polysulfides, sulfurized olefins, and sulfurized fats and oils.

In the present invention, zinc dithiophosphate and/or polysulfides are preferably used as extreme pressure additives and anti-wear agents.

When the lubricating oil composition of the present invention contains the extreme pressure additive, no particular limitation is imposed on the content thereof, which is, however, preferably from 0.05 to 5 percent by mass, more preferably from 0.1 to 2 percent by mass, particularly preferably from 0.2 to 1 percent by mass. When the extreme pressure additive is contained in an amount of less than 0.05 percent by mass, it has no effect of further improving the anti-wear properties and anti-seizure properties of the resulting composition. When the extreme pressure additive is contained in an amount of more than 5 percent by mass, the resulting composition would be significantly deteriorated in high temperature detergency.

The lubricating oil composition may contain an antioxidant other than Component (B) that is an aminic antioxidant, such as phenolic antioxidants and metallic antioxidants such as copper and molybdenum antioxidants. The content of these antioxidants if contained in the composition is generally from 0.1 to 5 percent by mass.

Examples of the friction modifier include ashless friction modifiers such as fatty acid esters, aliphatic amines, and fatty acid amides, and metallic friction modifiers such as molybdenum dithiocarbamates and molybdenum dithiophosphates. The content of the friction modifier is usually from 0.1 to 5 percent by mass on the basis of the composition.

Examples of the viscosity index improver include polymethacryalte, olefin copolymer, styrene-diene copolymer, styrene-maleic anhydride ester copolymer, and polyalkylstyrene viscosity index improvers. The mass average molecular weight of the viscosity index improver is usually from 10,000 to 1,000,000, preferably from 50,000 to 500,000. The content of the viscosity index improver if contained in the composition of the present invention is usually from 0.1 to 20 percent by mass on the basis of the composition.

Examples of the corrosion inhibitor include benzotriazole-, tolyltriazole-, thiadiazole-, and imidazole-types compounds.

Examples of the rust inhibitor include petroleum sulfonates, alkylbenzene sulfonates, dinonylnaphthalene sulfonates, alkenyl succinic acid esters, and polyhydric alcohol esters.

Examples of the demulsifier include polyalkylene glycol-based non-ionic surfactants such as polyoxyethylenealkyl ethers, polyoxyethylenealkylphenyl ethers, and polyoxyethylenealkylnaphthyl ethers.

Examples of the metal deactivator include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio) propionitrile.

Examples of the anti-foaming agent include silicone oil with a 25° C. kinematic viscosity of 100 to 100,000 $mm^2/s$, alkenylsuccinic acid derivatives, esters of polyhydroxy aliphatic alcohols and long-chain fatty acids, aromatic amine salts of methylsalicylate and o-hydroxybenzyl alcohol, aluminum stearate, potassium oleate, N-dialkyl-allylamine nitroaminoalkanol, and isoamyloctylphosphate, alkylalkylenediphosphates, metal derivatives of thioethers, metal derivatives of disulfides, fluorine compounds of aliphatic hydrocarbons, triethylsilane, dichlorosilane, alkylphenyl polyethylene glycol ether sulfide, and fluoroalkyl ethers.

When these additives are contained in the lubricating oil composition of the present invention, the corrosion inhibitor, rust inhibitor and demulsifier are each contained in an amount of usually 0.005 to 5 percent by mass, the metal deactivator is contained in an amount of usually 0.005 to 1 percent by mass, and the anti-foaming agent is contained in an amount of usually 0.0005 to 1 percent by mass, all on the basis of the total mass of the composition.

The kinematic viscosity at 100° C. of the lubricating oil composition of the present invention is necessarily 12.6 $mm^2/s$ or higher, preferably 13 $mm^2/s$ or higher, more preferably 14 $mm^2/s$ or higher. If the 100° C. kinematic viscosity is lower than 12.6 $mm^2/s$, the resulting composition would lack in oil film formation properties, possibly resulting in scuffing or excess wear.

The base number of the lubricating oil composition of the present invention is necessarily from 20 to 100 mgKOH/g so as to have excellent high temperature detergency and acid neutralization properties even for the case of using a high sulfur content fuel containing asphaltene. The lower limit is more preferably 25 mgKOH/g or greater, more preferably 30 mgKOH/g or greater while the upper limit is more preferably 90 mgKOH/g or smaller, more preferably 80 mgKOH/g or smaller. If the composition has a base number of smaller than 20 mgKOH/g, it would be insufficient in neutralizing power for acidic substances such as sulfuric acid generated by the combustion of fuel, possibly resulting in increased corrosive wear. If the composition has a base number of greater than 100 mgKOH/g, the base number is too much for neutralization of acidic substances such as sulfuric acid generated by the combustion of fuel and thus the excess basic substances would deposit in the form of ash on pistons, possibly causing the generation of excess wear such as scuffing.

No particular limitation is imposed on the metal content of the lubricating oil composition of the present invention. However, the lower limit is preferably 0.2 percent by mass or more, more preferably 0.4 percent by mass or more, more preferably 0.7 percent by mass or more while the upper limit is 3.6 percent by mass or less, more preferably 3.2 percent by mass or less, more preferably 2.9 percent by mass or less. If the composition has a metal content of less than 0.2 percent by mass, the composition would be insufficient in neutralizing power for acidic substances generated by the combustion of fuel and fail to exhibit high-temperature detergency. If the composition has a metal content of more than 3.6 percent by mass, ash generated after the combustion of fuel deposit on pistons and increases the wear of cylinders.

No particular limitation is imposed on the sulfated ash content of the lubricating oil composition of the present invention. However, the lower limit is 1.2 percent by mass or more, preferably 2 percent by mass or more, particularly preferably 3 percent by mass or more while the upper limit is preferably 20 percent by mass or less, more preferably 10 percent by mass or less. The sulfated ash content referred herein denotes the value measured by a method described by "Testing Methods for Sulfated Ash" stipulated in JIS K 2272 5 and mainly originates from metal-containing additives.

EXAMPLES

The present invention will be described in more detail with reference to the following Examples and Comparative Examples but are not limited thereto.

Examples 1 to 16, and Comparative Examples 1 to 13

Lubricating oil compositions of the present invention (Examples 1 to 16) and those for comparison (Comparative Examples 1 to 13) as set forth in Tables 1 and 2 were prepared. Each of the resulting compositions was evaluated for oxidation stability and anti-scuffing properties by PDSC oxidation stability test and high-temperature extreme pressure test. The results are also set forth in Tables 1 and 2. In Examples 1 to 15 and Comparative Examples 1 to 12, the blend ratio of two types of base oils was adjusted so that the compositions to which additives were added had a 100° C. kinematic viscosity of 20.5 $mm^2/s$. Metal detergents were added so that each of the composition had a base number of 40 mgKOH/g.

(Base Oil)

Base Oil A: 500 neutral (kinematic viscosity at 100° C.: 10.8 $mm^2/s$, viscosity index: 97, aromatic content: 32.2 mass %, % $C_A$: 7.4%)

Base Oil B: 150 bright stock (kinematic viscosity at 100° C.: 31.5 $mm^2/s$, viscosity index: 96, aromatic content: 35.7 mass %, % $C_A$: 7.4%)

Base Oil C: 250 neutral (kinematic viscosity at 100° C.: 7.1 $mm^2/s$, viscosity index: 96, aromatic content: 34.9 mass %, % $C_A$: 9.3%)

Base Oil D: poly-α-olefin (PAO) 10 (kinematic viscosity at 100° C.: 10 $mm^2/s$)

Base Oil D: poly-α-olefin (PAO) 40 (kinematic viscosity at 100° C.: 39 $mm^2/s$)

(Additives)

1) Metal Detergent (A) calcium phenate (calcium content: 9.2 mass %, base number: 250 mgKOH/g, metal ratio: 3.6)

calcium sulfonate (calcium content: 15.5 mass %, base number: 400 mgKOH/g)

calcium salicylate (calcium content: 8.2 mass %, base number: 230 mgKOH/g)

2) Antioxidant (B-1) diphenylamine (octyl/t-butyl mixture)

(B-2) N-phenyl-α-naphthylamine

Phenolic antioxidant (hindered phenol)

3) Oil-Soluble Molybdenum Compound (C-1) MoDTC (molybdenum content 10 mass %)

(C-2) MoDTP (molybdenum content 8 mass %)

(C-3) Organic molybdenum complex (molybdenum content 1.1 mass %)

(C-4) Molybdenum-amine complex (molybdenum content 10 mass %)

4) Ashless Dispersant (Alkenyl succinimide, bis type, nitrogen content: 1 mass %)

5) Zinc dialkyldithiophosphate (ZnDTP) (2-ethylhexyl, zinc content: 9.0 mass %, phosphorus content: 7.4 mass %)

6) Zinc dialkyldithiocarbamate (ZnDTC) (amyl, zinc content: 6.5 mass %, sulfur content: 12.0 mass %)

(PDSC Oxidation Stability Test)

A sample oil in an amount of 5 mg was taken and oxidized under an oxygen atmosphere at a pressure of 2 MPa and a temperature of 200° C. and evaluated by PDSC induction time that is the time until rapid heat generation occurred by oxidation.

(High-Temperature Extreme Pressure Test)

Each composition was evaluated for high-temperature extreme pressure properties using a reciprocating friction and wear testing machine (TE77 manufactured by Plint). At a load of 200 N, a vibration of 50 Hz, and a frequency of 50 Hz, the temperature of a test piece was increased from room temperature to 350° C. at a rate of 5° C./rain to measure the friction coefficient during the temperature increase. The temperature at which the friction coefficient is drastically increased is defined as TE77 anti-scuffing temperature.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Base Oil Composition | mass % | | | | | | | | | |
| Base Oil A (500 neutral) | mass % | 58 | 58 | 58 | 58 | 58 | 58 | 58 | 58 | 58 |
| Base Oil B (150 bright stock) | mass % | 42 | 42 | 42 | 42 | 42 | 42 | 42 | 42 | 42 |
| Base Oil C (250 neutral) | mass % | | | | | | | | | |
| Base Oil D (PAO-10) | mass % | | | | | | | | | |
| Base Oil E (PAO-40) | mass % | | | | | | | | | |
| (Aromatic Content in Base Oil) | mass % | 33.7 | 33.7 | 33.7 | 33.7 | 33.7 | 33.7 | 33.7 | 33.7 | 33.7 |
| (% $C_A$ of Base Oil) | | 7.4 | 7.4 | 7.4 | 7.4 | 7.4 | 7.4 | 7.4 | 7.4 | 7.4 |
| Metal Detergent | | | | | | | | | | |
| (A) Ca Phenate | inmass % | 3.2 | 3.2 | 3.2 | 3.2 | 3.2 | 3.2 | 3.2 | 3.2 | 1.6 |
| Ca Sulfonate | inmass % | 8.0 | 8.0 | 8.0 | 8.0 | 8.0 | 8.0 | 8.0 | 8.0 | 9.0 |
| Ca Salicylate | inmass % | | | | | | | | | |
| (Phenate Content) | mol/kg | 0.04 | 0.04 | 0.04 | 0.04 | 0.04 | 0.04 | 0.04 | 0.04 | 0.02 |
| Antioxidant | | | | | | | | | | |
| (B-1) Diphenylamine | inmass % | 0.3 | 0.5 | 0.3 | 0.5 | 0.3 | 0.15 | 0.3 | | 0.3 |
| (B-2) N-phenyl-α-naphthylamine | inmass % | | | | | | | | 0.3 | |
| Phenolic | inmass % | 0.3 | 0.0 | 0.0 | 0.0 | 0.0 | 0.0 | 0.0 | 0.0 | 0.0 |
| Oil Soluble Molybdenum Compound | | | | | | | | | | |
| (C-1) MoDTC | inmass % | 0.1 | 0.2 | 0.1 | 0.1 | 0.2 | 0.10 | 0.05 | 0.10 | 0.10 |
| (C-2) MoDTP | inmass % | | | | | | | | | |

TABLE 1-continued

| | | | | | | | | | | |
|---|---|---|---|---|---|---|---|---|---|---|
| (C-3) Organic Mo Complex | inmass % | | | | | | | | | |
| (C-4) | inmass % | | | | | | | | | |
| Mo Content | inmass % | 100 | 200 | 100 | 100 | 200 | 100 | 50 | 100 | 100 |
| Ashless Dispersant | inmass % | 2.0 | 2.0 | 2.0 | 2.0 | 2.0 | 2.0 | 2.0 | 2.0 | 2.0 |
| Zn DTP | inmass % | | | | | | | | | |
| Zn DTC | inmass % | | | | | | | | | |
| Zn Content | massppm | | | | | | | | | |
| Properties of Composition | | | | | | | | | | |
| Kinematic Viscosity (100° C.) | $mm^2/s$ | 20.5 | 20.5 | 20.5 | 20.5 | 20.5 | 20.5 | 20.5 | 20.5 | 20.5 |
| Base Number (perchloric acid method) | mgKOH/g | 40.0 | 40.0 | 40.0 | 40.0 | 40.0 | 40.0 | 40.0 | 40.0 | 40.0 |
| PDSC Induction Time | min | 88.7 | >120 | 79.2 | 116.3 | 115.4 | 55.3 | 44.0 | 54.2 | 69.2 |
| TE77 Anti-scuffing Temperature | ° C. | 253 | 263 | 251 | 260 | 262 | 259 | 230 | 233 | 245 |

| | | Example 10 | Example 11 | Example 12 | Example 13 | Example 14 | Example 15 | Example 16 |
|---|---|---|---|---|---|---|---|---|
| Base Oil Composition | mass % | | | | | | | |
| Base Oil A (500 neutral) | mass % | 58 | 58 | 58 | 43.5 | 29 | 65 | 94 |
| Base Oil B (150 bright stock) | mass % | 42 | 42 | 42 | 31.5 | 21 | 35 | 6 |
| Base Oil C (250 neutral) | mass % | | | | | | | |
| Base Oil D (PAO-10) | mass % | | | | 15 | 30 | | |
| Base Oil E (PAO-40) | mass % | | | | 10 | 20 | | |
| (Aromatic Content in Base Oil) | mass % | 33.7 | 33.7 | 33.7 | 25.3 | 16.8 | 33.4 | 32.4 |
| (% $C_A$ of Base Oil) | | 7.4 | 7.4 | 7.4 | 5.6 | 3.7 | 7.4 | 7.4 |
| Metal Detergent | | | | | | | | |
| (A) Ca Phenate | inmass % | 3.2 | 3.2 | 3.2 | 3.2 | 3.2 | 5.6 | 3.2 |
| Ca Sulfonate | inmass % | 8.0 | 8.0 | 8.0 | 8.0 | 8.0 | 14.0 | 8.0 |
| Ca Salicylate | inmass % | | | | | | | |
| (Phenate Content) | mol/kg | 0.04 | 0.04 | 0.04 | 0.04 | 0.04 | 0.07 | 0.04 |
| Antioxidant | | | | | | | | |
| (B-1) Diphenylamine | inmass % | 0.3 | 0.30 | 0.30 | 0.3 | 0.3 | 0.3 | 0.3 |
| (B-2) N-phenyl-α-naphthylamine | inmass % | | | | | | | |
| Phenolic | inmass % | 0.3 | 0.0 | 0.0 | | | | 0.3 |
| Oil Soluble Molybdenum Compound | | | | | | | | |
| (C-1) MoDTC | inmass % | | | | 0.1 | 0.1 | 0.1 | 0.1 |
| (C-2) MoDTP | inmass % | 0.13 | | | | | | |
| (C-3) Organic Mo Complex | inmass % | | 0.91 | | | | | |
| (C-4) | inmass % | | | 0.10 | | | | |
| Mo Content | inmass % | 100 | 100 | 100 | 100 | 100 | 100 | 100 |
| Ashless Dispersant | inmass % | 2.0 | 2.0 | 2.0 | 2.0 | 2.0 | 2.0 | 2.0 |
| Zn DTP | inmass % | | | | | | | |
| Zn DTC | inmass % | | | | | | | |
| Zn Content | massppm | | | | | | | |
| Properties of Composition | | | | | | | | |
| Kinematic Viscosity (100° C.) | $mm^2/s$ | 20.5 | 20.5 | 20.5 | 20.5 | 20.5 | 20.5 | 14.5 |
| Base Number (perchloric acid method) | mgKOH/g | 40.0 | 40.0 | 40.0 | 40.0 | 40.0 | 70.0 | 40.0 |
| PDSC Induction Time | min | 51.5 | 40.4 | 47.6 | 76.1 | 72.9 | 115.2 | 85.6 |
| TE77 Anti-scuffing Temperature | ° C. | 236 | 234 | 230 | 253 | 248 | 253 | 242 |

TABLE 2

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| Base Oil Composition | mass % | | | | | | | |
| Base Oil A (500 neutral) | mass % | 58 | 58 | 58 | 58 | 58 | 58 | 58 |
| Base Oil B (150 bright stock) | mass % | 42 | 42 | 42 | 42 | 42 | 42 | 42 |
| Base Oil C (250 neutral) | mass % | | | | | | | |
| Base Oil D (PAO-10) | mass % | | | | | | | |
| Base Oil E (PAO-40) | mass % | | | | | | | |
| (Aromatic Content in Base Oil) | mass % | 33.7 | 33.7 | 33.7 | 33.7 | 33.7 | 33.7 | 33.7 |
| (% $C_A$ of Base Oil) | | 7.4 | 7.4 | 7.4 | 7.4 | 7.4 | 7.4 | 7.4 |

TABLE 2-continued

| | | | | | | | | |
|---|---|---|---|---|---|---|---|---|
| Metal Detergent | | | | | | | | |
| (A) Ca Phenate | inmass % | 3.2 | 3.2 | 3.2 | 3.2 | 3.2 | | |
| Ca Sulfonate | inmass % | 8.0 | 8.0 | 8.0 | 8.0 | 8.0 | 10.0 | 9.0 |
| Ca Salicylate | inmass % | | | | | | | 1.7 |
| (phenate content) | mol/kg | 0.04 | 0.04 | 0.04 | 0.04 | 0.04 | 0.00 | 0.00 |
| Antioxidant | | | | | | | | |
| (B-1) Diphenylamine | inmass % | | 0.5 | | | | 0.3 | 0.3 |
| (B-2) N-phenyl-α-naphthylamine | inmass % | | | | | | | |
| Phenolic | inmass % | 0.0 | 0.5 | 1.0 | 0.0 | 0.5 | 0.0 | 0.0 |
| Oil Soluble Molybdenum Compound | | | | | | | | |
| (C-1) MoDTC | inmass % | | | | 1.0 | 0.2 | 0.1 | 0.1 |
| (C-2) MoDTP | inmass % | | | | | | | |
| (C-3) Organic Mo Complex | inmass % | | | | | | | |
| (C-4) | inmass % | | | | | | | |
| Mo Content | inmass % | 0 | 0 | 0 | 1000 | 200 | 100 | 100 |
| Ashless Dispersant | inmass % | 2.0 | 2.0 | 2.0 | 2.0 | 2.0 | 2.0 | 2.0 |
| Zn DTP | inmass % | | | | | | | |
| Zn DTC | inmass % | | | | | | | |
| Zn Content | massppm | | | | | | | |
| Properties of Composition | | | | | | | | |
| Kinematic Viscosity (100° C.) | $mm^2/s$ | 20.5 | 20.5 | 20.5 | 20.5 | 20.5 | 20.5 | 20.5 |
| Base Number (perchloric acid method) | mgKOH/g | 40.0 | 40.0 | 40.0 | 40.0 | 40.0 | 40.0 | 40.0 |
| PDSC Induction Time | min | 14.1 | 36.3 | 22.1 | 38.0 | 27.7 | 22.0 | 37.0 |
| TE77 Anti-scuffing Temperature | ° C. | 214 | 224 | 194 | 218 | 220 | 208 | 228 |

| | | Comparative Example 8 | Comparative Example 9 | Comparative Example 10 | Comparative Example 11 | Comparative Example 12 | Comparative Example 13 |
|---|---|---|---|---|---|---|---|
| Base Oil Composition | mass % | | | | | | |
| Base Oil A (500 neutral) | mass % | 58 | 58 | 14.5 | 0 | 65 | 35 |
| Base Oil B (150 bright stock) | mass % | 42 | 42 | 10.5 | 0 | 35 | |
| Base Oil C (250 neutral) | mass % | | | | | | 65 |
| Base Oil D (PAO-10) | mass % | | | 45 | 60 | | |
| Base Oil E (PAO-40) | mass % | | | 30 | 40 | | |
| (Aromatic Content in Base Oil) | mass % | 33.7 | 33.7 | 8.4 | 0 | 33.4 | 34.0 |
| (% $C_A$ of Base Oil) | | 7.4 | 7.4 | 1.9 | 0 | 7.4 | 8.6 |
| Metal Detergent | | | | | | | |
| (A) Ca Phenate | inmass % | 3.2 | 3.2 | 3.2 | 3.2 | 5.6 | 3.2 |
| Ca Sulfonate | inmass % | 8.0 | 8.0 | 8.0 | 8.0 | 14.0 | 8.0 |
| Ca Salicylate | inmass % | | | | | | |
| (phenate content) | mol/kg | 0.04 | 0.04 | 0.04 | 0.04 | 0.07 | 0.04 |
| Antioxidant | | | | | | | |
| (B-1) Diphenylamine | inmass % | 0.3 | 0.3 | 0.3 | 0.3 | | 0.3 |
| (B-2) N-phenyl-α-naphthylamine | inmass % | | | | | | |
| Phenolic | inmass % | 0.3 | 0.3 | | | | 0.3 |
| Oil Soluble Molybdenum Compound | | | | | | | |
| (C-1) MoDTC | inmass % | | | 0.1 | 0.1 | | 0.1 |
| (C-2) MoDTP | inmass % | | | | | | |
| (C-3) Organic Mo Complex | inmass % | | | | | | |
| (C-4) | inmass % | | | | | | |
| Mo Content | inmass % | 0 | 0 | 100 | 100 | 0 | 100 |
| Ashless Dispersant | inmass % | 2.0 | 2.0 | 2.0 | 2.0 | 2.0 | 2.0 |
| Zn DTP | inmass % | 0.11 | | | | | |
| Zn DTC | inmass % | | 0.15 | | | | |
| Zn Content | massppm | 100 | 100 | | | | |
| Properties of Composition | | | | | | | |
| Kinematic Viscosity (100° C.) | $mm^2/s$ | 20.5 | 20.5 | 20.5 | 20.5 | 20.5 | 10.5 |
| Base Number (perchloric acid method) | mgKOH/g | 40.0 | 40.0 | 40.0 | 40.0 | 70.0 | 40.0 |
| PDSC Induction Time | min | 34.6 | 36.8 | 60.3 | 47.7 | 30.3 | 84.1 |
| TE77 Anti-scuffing Temperature | ° C. | 225 | 223 | 238 | 214 | 218 | 222 |

As apparent from the results set forth in Tables 1 and 2, the lubricating oil compositions of the present invention had excellent results in PSDC oxidation stability test and high-temperature extreme pressure test. Whereas, the compositions containing no phenate metal detergent (Comparative Examples 6 and 7), those containing no aminic antioxidant (Comparative Examples 1 and 3 to 5), those containing no oil-soluble molybdenum compound (Comparative Examples 1 to 3, and 8 and 9) and those whose base oil contains less aromatic component (Comparative Examples 10 and 11) were poor in both or either of oxidation stability and anti-scuffing properties. The composition having a 100° C. kinematic viscosity of less than 12.6 (Comparative Example 13) is poor in anti-scuffing properties.

INDUSTRIAL APPLICABILITY

The lubricating oil composition of the present invention is excellent in heat-resistance and suitable as a cylinder lubricating oil composition for a crosshead type diesel engine and in particular exhibits excellent effects as a lubricating oil composition for a latest electronically-controlled two stroke cycle diesel engine driven under any or all of such conditions that an ultra long stroke is so that an average piston speed is 8 m/s or greater, preferably 8.5 m/s or greater, a combustion pressure is so that brake mean effective pressure (BMEP) is 1.8 MPa or greater, preferably 1.9 MPa or greater, and a cylinder wall temperature is so that the highest temperature thereof is 230° C. or higher, preferably 250° C. or higher, particularly preferably 270° C. or higher. The lubricating oil composition of the present invention can be used as diesel engine oils for various ships and for cogenerations other than as cylinder oils for crosshead-type diesel engines.

The invention claimed is:

1. A cylinder lubricating oil composition for a crosshead-type diesel engine, comprising:

a base oil having an aromatic content of 8.4 percent by mass or more and 40 percent by mass or less, and on the basis of the total mass of the composition (A) an alkaline earth metal phenate in an amount of 0.005 mole/kg or more on the basis of phenate soap content;

(B) an aminic antioxidant in an amount of 0.1 to 5 percent by mass; and (C) an oil-soluble molybdenum compound in an amount of 30 to 500 ppm by mass on the basis of molybdenum, and having a base number of 20 to 100 mgKOH/g and a 100° C. kinematic viscosity of 12.6 $mm^2/s$ or higher, wherein the base oil comprises a bright stock in an amount of 6 percent by mass or more on the basis of the total mass of the base oil and has a % $C_A$ of 1.9 or greater and (C) the oil-soluble molybdenum compound is molybdenum dithiocarbamate and/or molybdenum dithiophosphate.

2. The cylinder lubricating oil composition for a crosshead-type diesel engine according to claim 1, wherein (B) the aminic antioxidant is an alkyldiphenylamine and/or N-phenyl-α-naphthylamine.

3. The cylinder lubricating oil composition for a crosshead-type diesel engine according to claim 1, further comprising (D) an ashless dispersant in an amount of 1 to 8 percent by mass on the basis of the total mass of the composition.

4. The cylinder lubricating oil composition for a crosshead-type diesel engine according to claim 2, wherein (C) the oil-soluble molybdenum compound is molybdenum dithiocarbamate and/or molybdenum dithiophosphate.

5. The cylinder lubricating oil composition for a crosshead-type diesel engine according to claim 2, further comprising (D) an ashless dispersant in an amount of 1 to 8 percent by mass on the basis of the total mass of the composition.

6. The cylinder lubricating oil composition for a crosshead-type diesel engine according to claim 1, wherein the base oil comprises a bright stock in an amount of 21 percent by mass or more on the basis of the total mass of the base oil.

7. The cylinder lubricating oil composition for a crosshead-type diesel engine according to claim 1, wherein the base oil comprises a bright stock in an amount of 42 percent by mass or less on the basis of the total mass of the base oil.

8. The cylinder lubricating oil composition for a crosshead-type diesel engine according to claim 1, wherein the base oil has a % $C_A$ of 2.7 or greater.

* * * * *